US005318191A

United States Patent [19]

Pomales et al.

[11] Patent Number: 5,318,191

[45] Date of Patent: Jun. 7, 1994

[54] NIPPLE KLIPPER

[76] Inventors: Shirley Pomales, 7200 Boulevard East, #4F, No. Bergen, N.J. 07047; George Spector, 233 Broadway Rm 702, New York, N.Y. 10279

[21] Appl. No.: 69,209

[22] Filed: Jun. 1, 1993

[51] Int. Cl.[5] ..... A61J 9/08

[52] U.S. Cl. ..... 215/11.6; 24/510; 220/324

[58] Field of Search ..... 215/11.6; 24/510; 220/264, 315, 318, 326, 334

[56] References Cited

U.S. PATENT DOCUMENTS 2,090,749 8/1937 Corsi et al. ..... 215/11.6 X
2,480,247 8/1949 Jamison et al. ..... 215/11.6
2,663,529 12/1953 Lyttaker ..... 220/264 X
3,481,506 12/1969 Vevirit et al. ..... 220/264 X
4,690,300 9/1987 Woods ..... 220/264 X
4,971,211 11/1990 Lake ..... 215/11.6 X
5,114,374 5/1992 Estiva ..... 215/11.6 X

*Primary Examiner*—Allan N. Shoap
*Assistant Examiner*—Christopher J. McDonald

[57] ABSTRACT

A nipple clipper is provided for a baby bottle having a nipple which consists of a cap sized to fit over the nipple of the baby bottle. A clip is retained within the cap and is operable from the exterior of the cap for tightly gripping the nipple of the baby bottle when the cap is placed thereon, so that liquid within the baby bottle will not spill out.

3 Claims, 1 Drawing Sheet

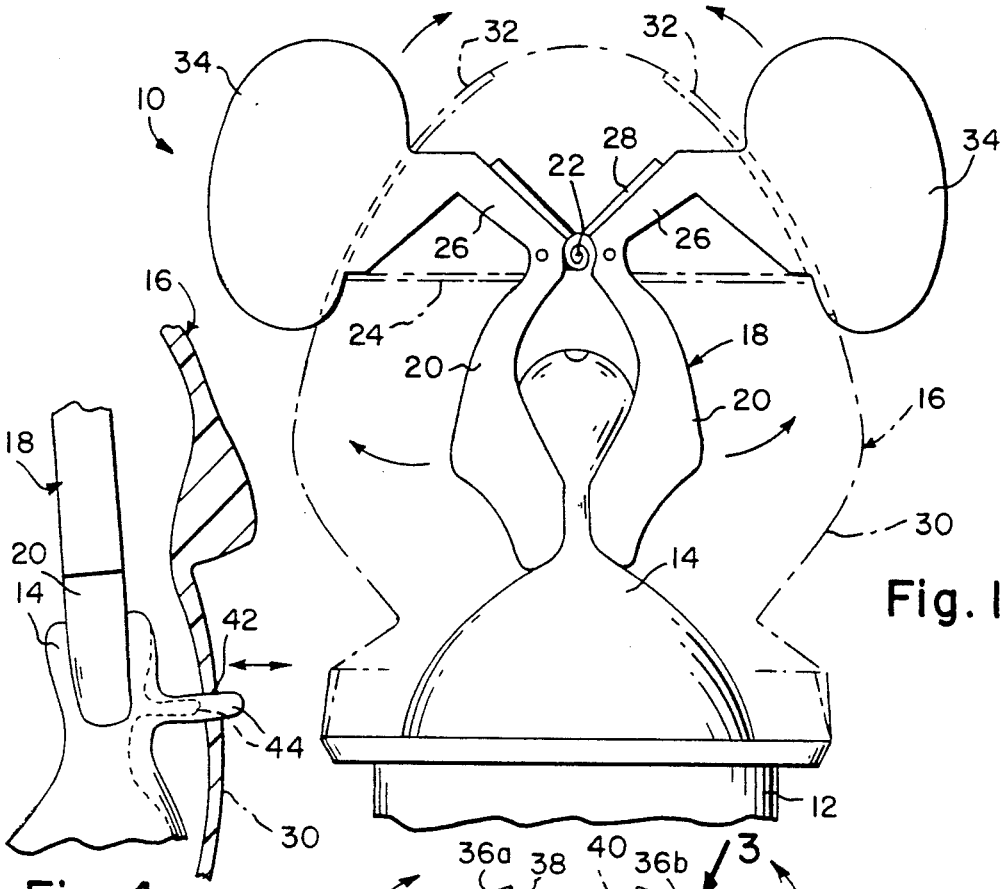
Fig. 1
Fig. 4
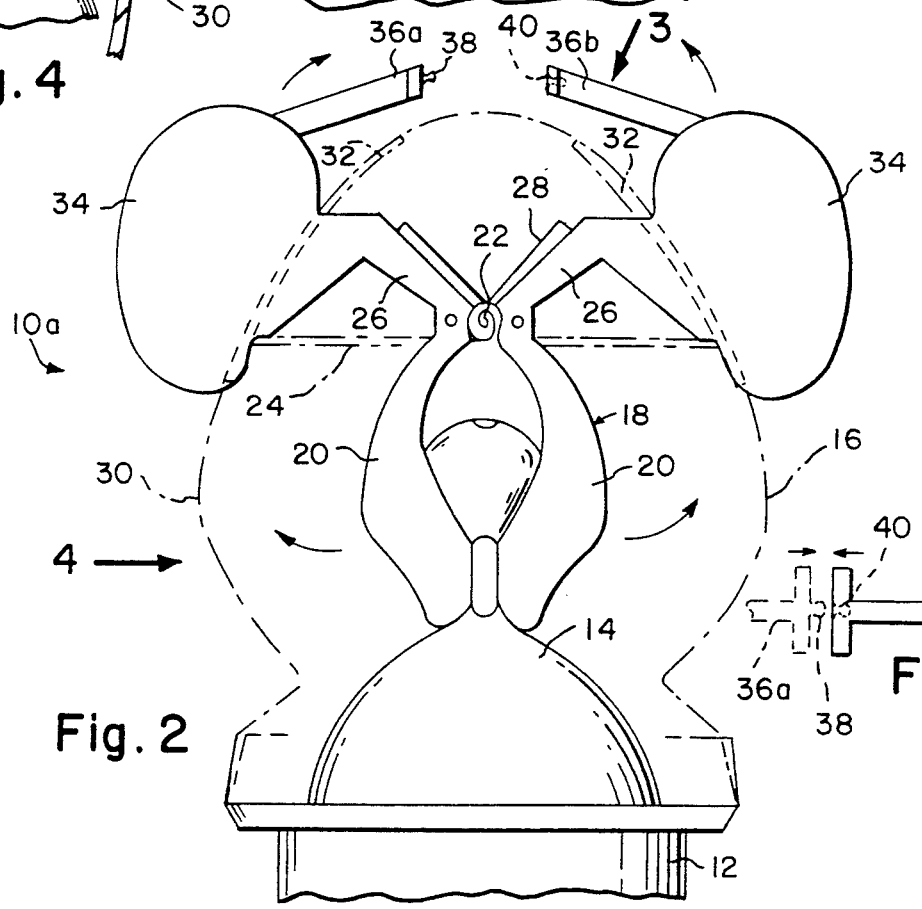
Fig. 2
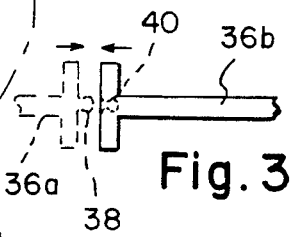
Fig. 3

NIPPLE KLIPPER

BACKGROUND OF THE INVENTION

The instant invention relates generally to baby bottle caps and more specifically it relates to a nipple clipper for a baby bottle, which provides a built-in spillage of liquid therefrom.

There are available various conventional baby bottle caps which do not provide the novel improvements of the invention herein disclosed.

SUMMARY OF THE INVENTION

A primary object of the present invention is to provide a nipple clipper for a baby bottle that will overcome the shortcomings of the prior art devices.

Another object is to provide a nipple clipper for a baby bottle that contains a clip within a cap, which will tightly grip a nipple of the baby bottle when the cap is placed thereon, so that liquid within the baby bottle will not spill out.

An additional object is to provide a nipple clipper for a baby bottle in which the exterior shape of the cap will be of an animal head and the ears be part of the clip, so that when the ears are pushed together, the clip will open to release the nipple and allow the cap to be removed therefrom.

A further object is to provide a nipple clipper for a baby bottle that is simple and easy to use.

A still further object is to provide a nipple clipper for a baby bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a diagrammatic vertical sectional view of the instant invention installed on a baby bottle, showing the cap in broken lines.

FIG. 2 is a diagrammatic vertical sectional view similar to FIG. 1 of a modification in which T-shaped handle extensions extend towards each other to better operate the clip.

FIG. 3 is a top view taken in the direction of arrow 3 in FIG. 2, showing one of the T-shaped handle extensions in greater detail.

FIG. 4 is a partial side cross sectional view taken in the direction of arrow 4 in FIG. 2, showing the animal tongue formed on the nipple protruding outside a mouth in the cap, when the clip is grasping the nipple and wherein the dotted line indicates when the clip is released, allowing the tongue to retract within the mouth.

DETAILED DESCRIPTION OF THE PREFERRED EMBODIMENTS

Turning now descriptively to the drawings, in which similar reference characters denote similar elements throughout the several views, FIG. 1 illustrates a nipple clipper 10 for a baby bottle 12 having a nipple 14, which consists of a cap 16 sized to fit over the nipple 14 of the baby bottle 12. A clip 18 is retained within the cap 16 and is operable from the exterior of the cap 16 for tightly gripping the nipple 14 of the baby bottle 12 when the cap 16 is placed thereon, so that liquid within the baby bottle 12 will not spill out.

The clip 18 includes a pair of jaws 20 hinged together at 22, to an internal portion 24 of the cap 16. A pair of handles 26 are provided, with each integral with and extending from one of the jaws 20 out through the cap 16. A spring 28 is located at the hinged jaws 20 and between the handles 26, to normally bias the jaws 20 together and the handles 26 apart. When a person squeezes the handles 26 together, the jaws 20 will move apart.

The cap 16 includes a casing 30 configured to resemble a head of an animal having a slot 32 on opposite sides thereof. A distal free end 34 of each handle 26 of the clip 18 extends through one slot 32, configured to resemble an ear of the animal.

A modified nipple clipper **10*a* is shown in FIG. 2 and further includes a pair of T-shaped handle extensions 36*a*, 36*b*, with each affixed to one distal free end 34 of one handle 26, whereby the extensions 36 extend towards each other. The first extension 36*a* has a female socket 40 therein. When the extensions 36*a*, 36*b* are pulled together, the male plug 38 can enter the female socket 40 to keep the jaws apart 20 (see FIG. 3**).

As shown in FIG. 5, the casing 30 has an opening 42 therethrough to resemble a mouth of the animal and a tongue 44 is formed on the nipple 14. When the jaws 20 of the clip 18 are grasping the nipple 14, said tongue 44 will extend through the mouth opening 42. When the jaws 20 are released, the tongue 44 will retract within the casing 30.

OPERATION OF THE INVENTION

To use the nipple clipper 10, a person simply presses the distal free ends 34 together. This will cause the jaws 20 to move apart. The casing 30 can now be placed over the nipple 14. When the distal free ends 34 are released, the jaws 20 will come together to tightly grip the nipple 14.

To use the modified nipple clipper **10*a*, the person simply presses the T-shaped handle extensions 36*a*, 36*b* together. This will cause the jaws 20 to move apart. The male plug 38 will enter the female socket 40 to keep the jaws 20 apart, so that the casing can be placed over the nipple 14. When the male plug 38 is disengaged from the female socket 40, the jaws 20 will come together to tightly grip the nipple 14**.

While certain novel features of this invention have been shown and described and are pointed out in the annexed claims, it will be understood that various omissions, substitutions and changes in the forms and details of the device illustrated and in its operation can be made by those skilled in the ar without departing from the spirit of the invention.

What is claimed is:

1. A nipple clipper for a baby bottle having a nipple which comprises:

a) a cap sized to fit over the nipple of the baby bottle;

b) a clip retained within said cap and operable from the exterior of said cap for tightly gripping the nipple of the baby bottle when said cap is placed thereon, so that liquid within the baby bottle will not spill out; wherein said clip includes:

c) a pair of jaws hinged together to an internal portion of said cap;

d) a pair of handles, each integral with and extending from one of said jaws out through said cap;

e) a spring located at said hinged jaws and between said handles to normally bias said jaws together and said handles apart, so that when a person squeezes said handles together said jaws will move apart; wherein said cap includes:

f) a casing configured to resemble a head of an animal having a slot on opposite sides thereof; and g) a distal free end of each said handle of said clip extending through one said slot configured to resemble an ear of the animal.

2. A nipple clipper as recited in claim 1, further including:

a) a pair of T-shaped handle extensions, each affixed to one distal free end of one of said handle, whereby said extensions extend towards each other;

b) said first extension having a male plug thereon; and c) said second extension having a female socket therein, so that when said extensions are pulled together said male plug can enter said female socket to keep said jaws apart.

3. A nipple clipper as recited in claim 2, further including:

a) said casing having an opening therethrough to resemble a mouth of the animal; and b) a tongue formed on the nipple, so that when said jaws of said clip are grasping the nipple, said tongue will extend through said mouth opening and when said jaws are released said tongue will retract within said casing.

* * * * *